US010790615B2

(12) United States Patent
Vega et al.

(10) Patent No.: US 10,790,615 B2
(45) Date of Patent: Sep. 29, 2020

(54) CABLE QUICK CONNECTOR ADAPTER

(71) Applicant: Raytheon Company, Waltham, MA (US)

(72) Inventors: Jonathan Vega, Dunedin, FL (US); Alan K. Rubin, Seminole, FL (US); Kenneth Leonard, Seminole, FL (US); Matthew Krasne, Seminole, FL (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 16/235,567

(22) Filed: Dec. 28, 2018

(65) Prior Publication Data

US 2020/0212626 A1 Jul. 2, 2020

(51) Int. Cl.
*H01R 13/639* (2006.01)
*H01R 13/73* (2006.01)

(52) U.S. Cl.
CPC ..... *H01R 13/639* (2013.01); *H01R 13/73* (2013.01)

(58) Field of Classification Search
CPC ..... H01R 13/639; H01R 13/73
USPC ..... 439/349, 320
See application file for complete search history.

(56) References Cited

U.S. PATENT DOCUMENTS 3,328,743 A 6/1967 Acord
4,235,498 A 11/1980 Snyder
4,629,272 A 12/1986 Mattingly et al.
4,676,573 A 6/1987 Norman
4,695,109 A 9/1987 Ratchford
4,702,537 A 10/1987 Mattingly et al.
4,808,123 A * 2/1989 Dee ..... H01R 13/59 439/321
5,082,454 A 1/1992 Tonkiss et al.
5,145,394 A * 9/1992 Hager ..... H01R 13/622 285/92
6,123,563 A * 9/2000 Johnson ..... H01R 13/622 439/321
6,131,961 A 10/2000 Hellmann
6,152,753 A * 11/2000 Johnson ..... H01R 13/622 439/312
6,386,897 B1 5/2002 Muller
7,824,204 B2 * 11/2010 Fujiwara ..... H01R 13/5219 439/311
7,845,963 B2 * 12/2010 Gastineau ..... H01R 13/639 439/321

(Continued)

*Primary Examiner* — Peter G Leigh

(57) ABSTRACT

A quick connect adapter is provided for locking together a pair of coupled or mated electronic cable connectors via axial movement of an outer sleeve of the quick connect adapter. The outer sleeve can comprise a plurality of protrusions formed inwardly about the outer sleeve. An inner sleeve can have a plurality of slots and a spring seat channel in open communication with the plurality of slots. A radial compression spring can be supported in the spring seat channel, and can be operable between an uncompressed state and a compressed state. Upon connecting a first cable connector body to a second cable connector body, and in response to axial movement of the outer sleeve in a direction towards the radial compression spring, the plurality of protrusions slide through the plurality of slots to engage and compress the radial compression spring, thus locking the connection of the first cable connector body to the second cable connector body.

25 Claims, 9 Drawing Sheets

(56) References Cited

U.S. PATENT DOCUMENTS

| | | | | |
|---|---|---|---|---|
| 7,850,472 | B2 * | 12/2010 | Friedrich | H01R 13/506 439/256 |
| 7,905,741 | B1 * | 3/2011 | Wade | H01R 13/639 439/321 |
| 7,914,311 | B1 * | 3/2011 | Gallusser | H01R 13/639 439/321 |
| 9,106,012 | B2 * | 8/2015 | Gross, III | H01R 13/622 |
| 9,217,524 | B2 * | 12/2015 | Nick | F16L 19/005 |
| 9,362,666 | B2 * | 6/2016 | Laughlin | H01R 13/629 |
| 9,397,441 | B2 * | 7/2016 | Sun | H01R 13/622 |
| 9,531,120 | B2 * | 12/2016 | Bates, III | H01R 13/533 |
| 9,559,457 | B2 * | 1/2017 | Strahl | H01R 13/622 |
| 9,559,458 | B2 * | 1/2017 | Zhang | |
| 9,666,973 | B1 * | 5/2017 | Strahl | H01R 13/622 |
| 9,887,494 | B2 * | 2/2018 | Leroyer | H01R 13/533 |
| 2005/0048827 | A1 | 3/2005 | Curly et al. | |
| 2006/0051999 | A1 * | 3/2006 | Allemann | H01R 13/622 439/320 |
| 2008/0012330 | A1 * | 1/2008 | Leroyer | H01R 13/622 285/386 |
| 2011/0294329 | A1 * | 12/2011 | Sasaki | H01R 13/623 439/320 |
| 2011/0318098 | A1 * | 12/2011 | Gloaguen | F16L 19/005 403/350 |
| 2017/0310044 | A1 * | 10/2017 | Smajda | B61G 5/10 |
| 2018/0366873 | A1 * | 12/2018 | Menolotto | H01R 13/6277 |

* cited by examiner

CABLE QUICK CONNECTOR ADAPTER

BACKGROUND

Traditional electronic cable connectors (such as military spec bayonet style connectors) require rotation or twisting of one component relative to another component to lock together a pair of coupled/mated cable connectors. And, of course, opposite rotation is required to unlock the pair of cable connectors from each other so that the connectors can be disconnected from each other. However, in high volume applications where a plurality of such cable connectors need to be repeatedly locked/connected and unlocked/disconnected, operators are prone to fatigue and injuries from carrying out such repetitive twisting motions. Furthermore, many designs require specific connectors to be used based on system and application specific requirements and/or customer specifications, particularly in applications involving high performance components. These connectors require the aforementioned twisting and rotating for connection and disconnection, and do not provide a quicker, less cumbersome means of connecting and disconnecting connectors.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
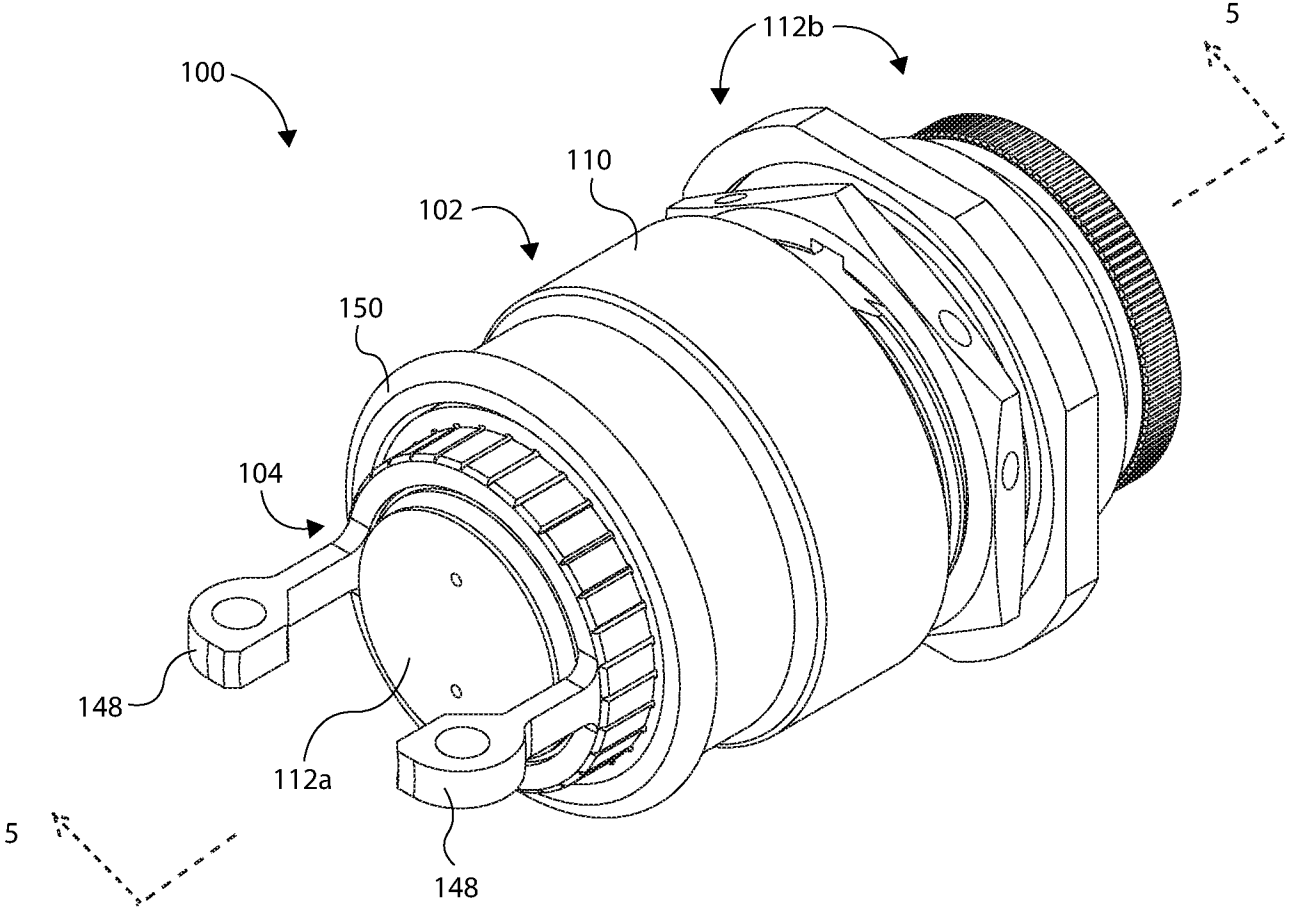
FIG. 1 is an isometric view of a quick connect system having a quick connect adapter, in accordance with an example of the present disclosure.
Figure 2:
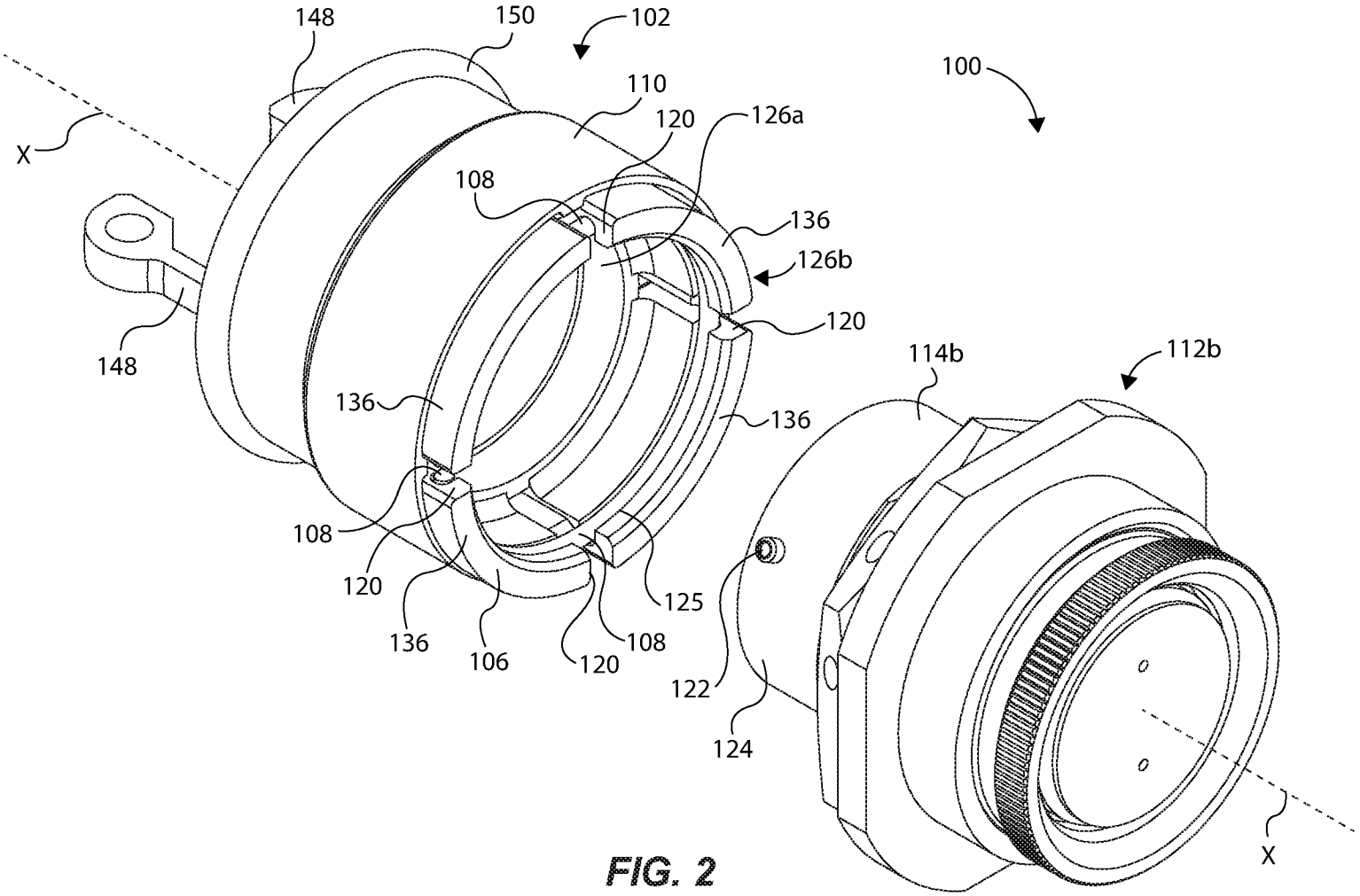
FIG. 2 is a partially exploded isometric view of the quick connect system of FIG. 1.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

An initial overview of the inventive concepts are provided below and then specific examples are described in further detail later. This initial summary is intended to aid readers in understanding the examples more quickly, but is not intended to identify key features or essential features of the examples, nor is it intended to limit the scope of the claimed subject matter.

In one example, the present disclosure sets forth a quick connect adapter for locking a pair of coupled electronic cable connectors comprising an inner sleeve comprising first and second collar sections. The first collar section can be configured to be secured to a first connector body, and the second collar section can comprise a plurality of slots and a spring seat channel in open communication with the plurality of slots. An outer sleeve can comprise a plurality of protrusions formed inwardly about an inner surface of the outer sleeve and can be operable to axially slide through the plurality of slots of the inner sleeve. A radial compression spring can be configured to be supported in the spring seat channel of the inner sleeve, and can be operable between an uncompressed state and a compressed state. Upon connecting a first cable connector body to a second cable connector body, and in response to axial movement of the outer sleeve in a direction towards the radial compression spring, the plurality of protrusions of the outer sleeve slide through the plurality of slots to engage and compress the radial compression spring, thus locking the connection of the first cable connector body to the second cable connector body.

In one example, the present disclosure sets forth a quick connect system for locking a pair of coupled cable connectors comprising a first cable connector body comprising a mating end having an outer surface and at least one stop protrusion extending from the outer surface, and a second cable connector body comprising a mating end for coupling to the mating end of the first cable connector body. The system can comprise a connector support collar coupled to the second connector body, and an inner sleeve comprising first and second collar sections. The first collar section can be axially biased between the connector support collar and the second connector body, and the second collar section can comprise a plurality of slots and a spring seat channel in open communication with the plurality of slots. The system can comprise an outer sleeve slidably interfaced to the connector support collar, and can comprise a plurality of protrusions formed inwardly about an inner surface of the outer sleeve. The system can comprise a radial compression spring supported in the spring seat channel of the inner sleeve, and can be operable between an uncompressed state and a compressed state. When the first and second cable connector bodies are connected to each other, the outer sleeve can be operable to axially slide about the inner sleeve towards the radial compression spring, such that the plurality of protrusions slide through the plurality of slots to engage and compress the radial compression spring around the outer surface of the first cable connector body adjacent the at least one stop protrusion to lock the connection of the first cable connector body to the second cable connector body.

In one example, the present disclosure sets forth a method for locking a pair of coupled cable connectors together comprising: (a) connecting a first cable connector body to a second cable connector body; (b) sliding an inner sleeve over the first cable connector body and around a connection interface of the first and second cable connector bodies (the inner sleeve comprising a plurality of slots and a spring seat channel supporting a radial compression spring); (c) coupling a connector support collar to the first cable connector body to secure the inner sleeve to the first cable connector body; (d) sliding an outer sleeve over the connector support collar and the inner sleeve; and (d) axially slidably engaging a plurality of protrusions of the outer sleeve through the plurality of slots to engage and compress the radial compression spring around the second connector body, thereby locking the connection of the first cable connector body to the second cable connector body.

In one example, the present disclosure sets forth a method for replacing a rotary locking mechanism of a pair of cable connectors with an axial locking mechanism comprising: (a) removing a rotary locking mechanism from a first connector body (the rotary locking mechanism comprising a pre-existing connector support body and a pre-existing twistable connector body, the pre-existing twistable connector body operable to be rotated to lock the first cable connector body to a second cable connector body); (b) providing an axial locking mechanism that replaces the rotary locking mechanism (the axial locking mechanism comprising a connector support body, an inner sleeve; and outer sleeve, and a radial compression spring); (c) connecting the first cable connector body to the second cable connector body; (d) sliding the inner sleeve over the first cable connector body and around a connection interface of the first and second cable connector bodies (the inner sleeve comprising a plurality of slots and a spring seat channel supporting the radial compression spring); (e) coupling the connector support collar to the first cable connector body to secure the inner sleeve to the first cable connector body; (f) sliding the outer sleeve over the connector support collar and the inner sleeve; and (g) axially sliding a plurality of protrusions of the outer sleeve through the plurality of slots of the inner sleeve to engage and compress the radial compression spring around the second connector body, thereby locking the connection of the first cable connector body to the second cable connector body.

Figure 5:
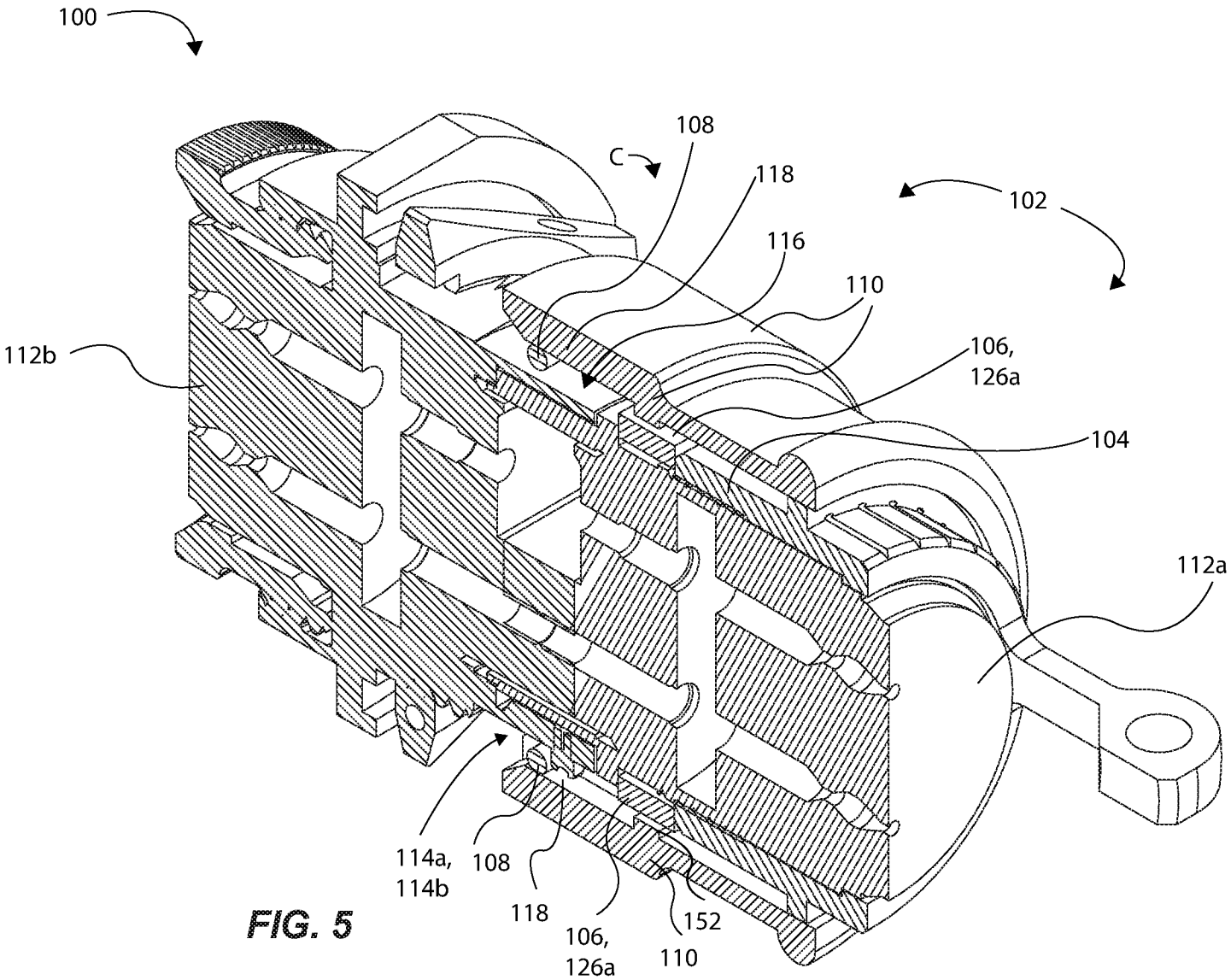
FIG. 5 is an isometric cross sectional view of the quick connect system of FIG. 1, and taken along lines 5-5.

To further describe the present technology, examples are now provided with reference to the figures. With reference to FIGS. 1-7, a quick connect system 100 is shown for locking together a pair of mated or coupled cable connectors. As an overview, and with particular reference to FIGS. 2-4, the quick connect system 100 can comprise a quick connect adapter 102 that includes a connector support collar 104, an inner sleeve 106, a radial compression spring 108, and an outer sleeve 110. The quick connect system 100 can further comprise a first connector body 112*a* and a second connector body 112*b*, which are operable to be mechanically and electrically coupled together, such as is achieved with typical cable connectors that can be connected and disconnected from each other (e.g., military spec connectors, such as Mil-spec connector MIL-DM-38999). As further detailed below with reference to FIGS. 5-7, in operation the first and second connector bodies 112*a* and 112*b* are initially connected or mated together about respective mating ends 114*a* and 114*b* (see also FIG. 4). Then, the inner sleeve 106 (supporting/retaining the radial compression spring 108) can be slid over the first connector body 112*a* and around a connection interface 116 of the mating ends 114*a* and 114*b* (FIG. 5). Next, the connector support collar 104 can be engaged (e.g., threadably engaged via mating threads) to the first connector body 112*a* to sandwich or compress the inner sleeve 106, which secures the inner sleeve 106 to the first connector body 112*a*. Then, the outer sleeve 110 can be slid over the connector support collar 104, and a plurality of protrusions 118 of the outer sleeve 110 can be aligned with a plurality of slots 120 of the inner sleeve 106. Once aligned, the outer sleeve 110 can be axially slid along the inner sleeve 106 along a longitudinal axis X, such that the plurality of protrusions 118 interface with and axially slide through respective slots 120. As a result, the plurality of protrusions 118 engage and compress the radial compression spring 108 by applying an inward compression force, which causes it to transition from an uncompressed state U (FIG. 6) to a compresses state C (FIGS. 5 and 7), thereby compressing the radial compression spring 108, and causing its diameter to decrease (i.e., it shrinks in diameter). When in the compressed state C, the radial compression spring 108 is compressed or deflected around the mating end 114*a* of the second connector body 112*b*, and in a position adjacent a plurality of stop protrusions 122 extending from an outer surface 124 of the second connector body 112*a*. This "compressed state" or position axially locks the first and second connector bodies 112*a* and 112*b* together. This is because the stop protrusions 122 act as a stop to the radial compression spring 108, and because the radial compression spring 108 remains supported or retained by a spring seat channel 125 of the inner sleeve 106 when compressed, the spot protrusions 122 restricting axial movement of the inner sleeve 106 and the radial compression spring 108 away from the second connector body 112*a*. And, because the inner sleeve 106 is secured to the first connector body 112*a* (discussed above), the result is that the first and second connector bodies 112*a* and 112*b* are locked together so that they cannot be axially pulled apart from each other.

To unlock the first and second cable connector bodies 112*a* and 112*b* from each other, the operator simply axially slides the outer sleeve 110 away from the second cable connector body 112*b*, such that the protrusions 118 slide back through the slots 120 in the opposite direction described above. This disengages the protrusions 118 from the radial compression spring 108, which, because it is compliant or elastic in nature, the radial compression spring 108 automatically returns to the uncompressed state U (i.e., the spring expands or increases in diameter). This "expansion" provides sufficient clearance of the radial compression spring 108 so that it can freely pass beyond the stop protrusions 122. This unlocks the first cable connector body 112*a* from the second cable connector body 112*b* so that the operator can pull them apart from each other for disconnection thereof. Note that the stop protrusions 122 could be existing features of an existing/known connector body, such that the stop protrusions 122 would be used with a pre-existing rotational component (e.g., bayonet style connector) to lock the first and second connector bodies 122*a* and 122*b* together.

Advantageously, locking the cable connector bodies 112*a* and 112*b* together is achieved by axially movement of the outer sleeve 110 over the inner sleeve 106 to compress the radial compression spring 108. Compare this to prior cable connection systems, such as discussed above, that have a rotary locking mechanism that requires rotational or twisting movement of some component relative to one another component to lock or unlock cable connectors to and from each other. Conversely, the present technology provides a quick cable connector or adapter (i.e., 102) that utilizes axial movement of the outer sleeve 110 to lock or unlock the cable connector bodies 112*a* and 112*b* about each other. This can be a quicker operation than rotary connection systems because such axial movement takes less time to achieve than rotational movement to lock together the same or similar connector bodies.

This can also reduce operator fatigue and reduce the risk of injury as the operator can avoid significant and repeated exertion of rotational energy to lock/unlock connector bodies about each other.

The quick connect adapter 102 described herein can replace existing rotary locking components of existing cable connection systems, such as military spec connectors. For instance, such rotary locking components (not shown) can comprise a pre-existing connector support body and a pre-existing twistable connector body operable to be rotated by an operator to lock the first cable connector body 112*a* to the second cable connector body 112*b*. The pre-existing connector support body and pre-existing twistable connector body can be removed from such system, and then replaced with the quick connect adapter 102 described herein. That is, in the example shown, the first and second cable connector bodies 112*a* and 112*b* could remain in place to be used, and the quick connect adapter 102 could be used as an "adapter" to replace any existing connector support body and twistable connector body, and to adapt together the existing first and second cable connector bodies 112*a* and 112*b*, as will be appreciated from the following discussion.

With more particular reference to the features of the quick connect adapter 102, the inner sleeve 106 can comprise first and second collar sections 126*a* and 126*b*. The first collar section 126*a* can be an annular ring shaped body that has a smaller diameter and thickness defined by the second collar section 126*b*. The first collar section 126*a* can comprise first and second outer planar surfaces 128*a* and 128*b* (FIGS. 6 and 7) that are axially biased or situated between the connector support collar 104 and the first connector body 112*a*. That is, the first planar surface 128*a* can be biased against an outer ring surface 130 of the connector support collar 104, while the second planar surface 128*b* is biased against a flange 132 of the first cable connector body 112*a*. In this manner, because the connector support collar 104 is threadably coupled to the first cable connector body 112*a* (via threaded interface 134 of FIG. 6), the inner sleeve 106 is therefore secured to the first connector body 112 and the connector support collar 104 via the first collar section 126*a*.

Figures 3, 3A:
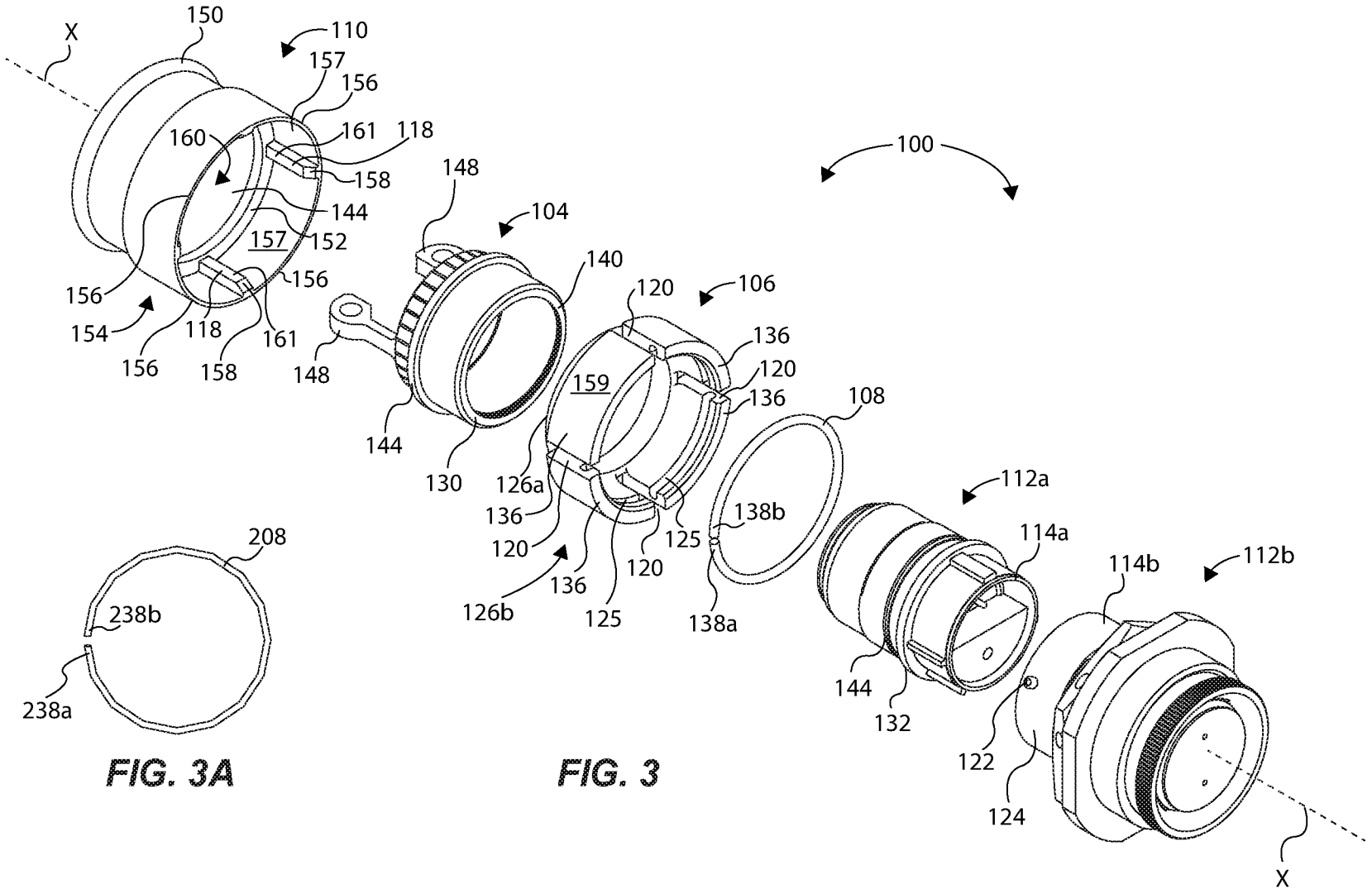
FIG. 3 is an exploded isometric view of the quick connect system of FIG. 1.
FIG. 3A is a front view of an alternative radial compression spring that could replace the radial compression spring of the quick connect system of FIG. 3.
Figure 4:
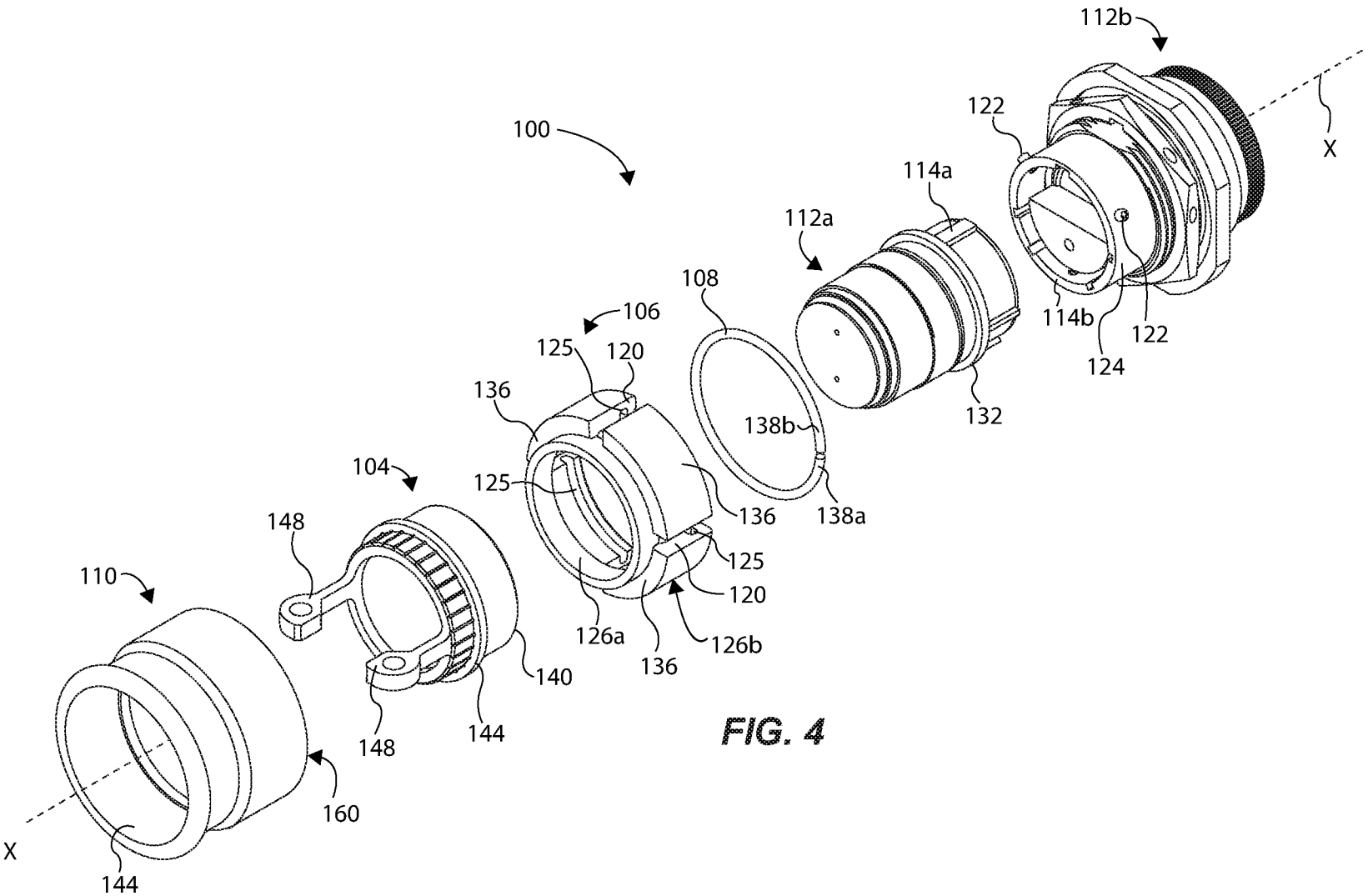
FIG. 4 is an exploded isometric view of the quick connect system of FIG. 1.

As shown in FIG. 3, the second collar section 126*b* of the inner sleeve 106 can comprise a plurality of spring support portions 136 defined by the plurality of slots 120. The four spring support portions 136 are formed as arced portions separated by respective slots 120. Note that the slots 120 are formed as generally rectangular slots in a direction along the longitudinal axis X, and are spaced evenly from each other around a circumferential envelope defined by the second collar section 126*b*. Each slot 120 can be open on both ends of the slot, so that respective protrusions 118 can engage and slide through the slots 120 from one end to the other end of the respective slot 120.

The spring seat channel 125 can be defined by four U-shaped or C-shaped recesses formed radially through respective inner areas or surfaces of the spring support portions 136. In this way, the spring seat channel 125 is in fluid or open communication with the slots 120. The spring seat channel 125 is therefore configured to support and retain the radial compression spring 108, and is sized (i.e., has a particular width and depth) such that the radial compression spring 108 remains seated in the spring seat channel 125 when the radial compression spring 108 is in both the uncompressed state U and the compressed state C. That is, the radial compression spring 108 does not become fully unseated from the spring seat channel 125 when compressed, so that the inner sleeve 106 can become and remain locked to the second cable connector body 112*b* when the radial compression spring 108 is compressed radially inwardly (see also FIGS. 5 and 7).

Note that the radial compression spring 108 can be a split ring formed of metal (or other suitable material) that is compliant enough to compress when pressed radially upon, and compliant enough to spring back or automatically return to its original size and shape. Thus, the radial compression spring 108 can have first and second ends 138*a* and 138*b* (FIG. 3) separated by a gap, so that when the protrusions 118 of the outer sleeve 110 engage and compress an outer surface of the radial compression spring 108, the radial compression spring 108 compresses and flexes inwardly, thereby moving the first and second ends 138*a* and 138*b* closer together, which reduces or eliminates the gap that separates them. In other words, the radial compression spring 108 transitions from a first diameter (uncompressed state of FIG. 6) to a second diameter (compressed state of FIG. 7), where the first diameter is greater than the second diameter.

FIG. 3A shows an alternative radial compression spring 208 that could replace the radial compression spring 108 of FIG. 3. Therefore, similarly as with the radial compression spring 108, the alternative radial compression spring 208 can comprise a split ring having first and second ends 238*a* and 238*b* separated by a gap, so that when the protrusions 118 of the outer sleeve 110 engage and compress an outer surface of the radial compression spring 208, the radial compression spring 208 compresses and flexes inwardly, thereby moving the first and second ends 238*a* and 238*b* closer together, which reduces or eliminates the gap that separates them and reduces the diameter of the radial compression spring 208. The alternative radial compression spring 208 can have a polygon shaped profile around its perimeter, such as having a plurality of straight or linear portions (e.g., 12 total) interconnected together to generally form a ring shaped spring member. The configuration of the alternative radial compression spring 208 assists to better grip or grab around the stop protrusions 122 of the second connector body 112*b*, because it provides more surface area and leverage for gripping or interfacing between the spring 208 and the stop protrusions 122, and also better gripping in the spring seat channel 125 because of the polygon shape of the spring 208.

Figure 6:
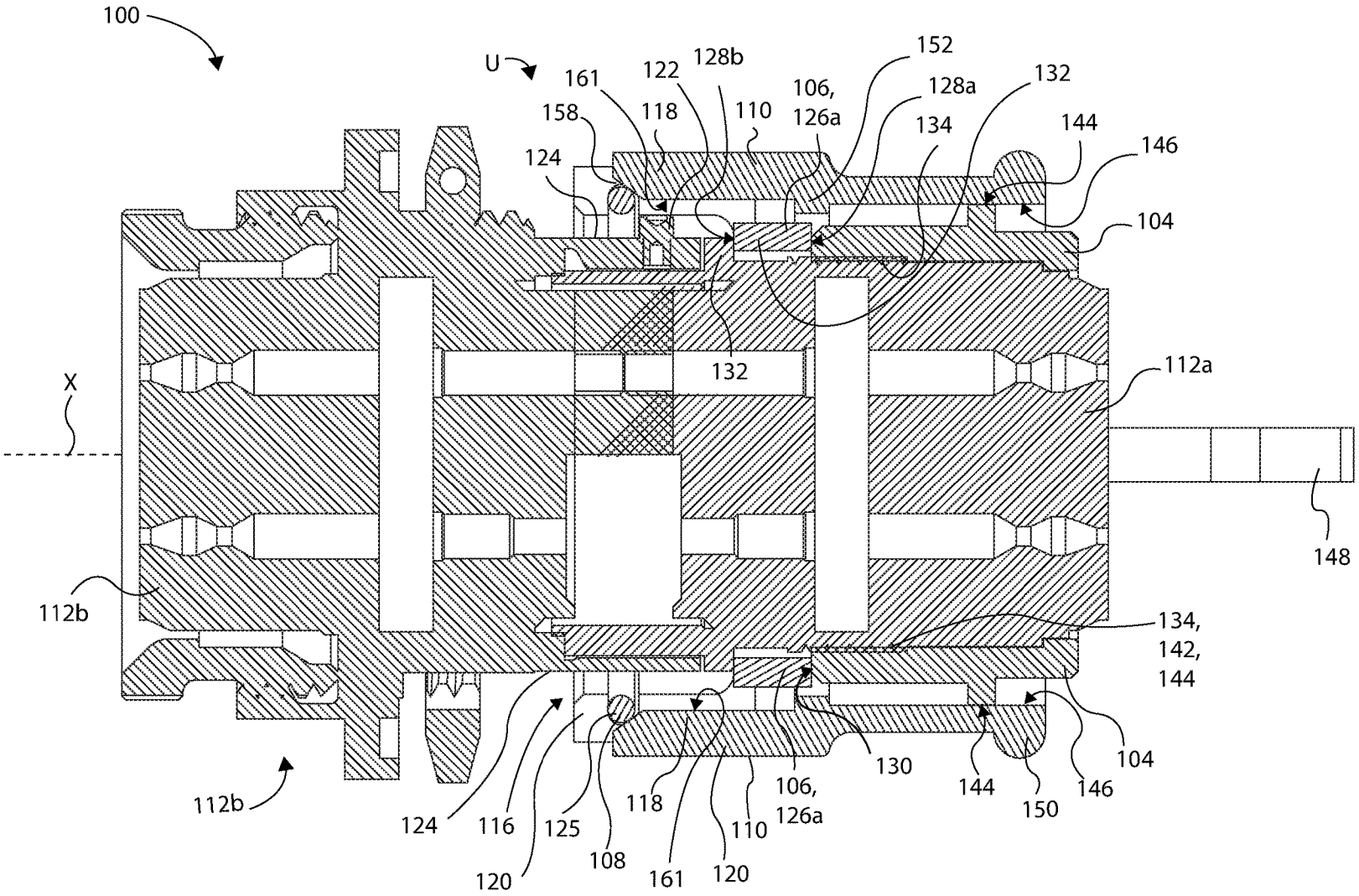
FIG. 6 is a front view of the quick connect system of FIG. 5, showing the quick connect adapter in an uncompressed state.

The connector support body 104 can comprise a mating end 140 that includes inner threads 142 that engage with outer threads 144 of the first cable connector body 112*a* (which defines the aforementioned threaded interface 134 shown in FIG. 6). Accordingly, a portion of the first cable connector body 112*a* is situated within the mating end 140, so that the connector support body 104 surrounds the first cable connector body 112*a* and is secured thereto. The connector support body 104 can further comprise a collar interface surface 144 that slidably interfaces with a connector support body interface surface 146 of the outer sleeve 110 (see FIGS. 3, 4 and 6). Thus, the connector support body 104 facilitates slidable movement of the outer sleeve 110 relative to the first cable connector body 112*a* and the inner sleeve 106. The connector support body 104 can further comprise a pair of mounting arms 148 for mounting or coupling to a structure or other device, such as a pair of brackets fastened together that can support a cable that is attached to the first connector body 112*a*, as with some military spec connectors. Note that the mounting arms 148 may vary in shape and form, depending on the particular requirements of the connector system, or depending on the particular/supplied connector support body (see e.g., support body 204 of FIG. 8, which is a pre-existing back shell supplied by existing vendors).

The outer sleeve 110 can comprise a user engagement member 150 (e.g., a protruding structural grip, knob, handle or other structural device or member that a user can grasp and interface with) that extends outwardly around the outer sleeve 110, so that the user can grasp and push/pull the outer sleeve 110 axially back and forth over the inner sleeve 106. The outer sleeve 110 can further comprise an inner annular flange 152 (FIGS. 3 and 6) that operates as a stop against the second collar section 126*b* of the inner sleeve 106 so that the outer sleeve 110 cannot be moved too far over or beyond the inner sleeve 106 when compressing the radial compression spring 108. The outer sleeve 110 can comprise an operating section 154 that includes radial wall portions 156 and the plurality of protrusions 118, whereby the radial wall portions 156 are separated by respective protrusions 118. The plurality of protrusions 118 can be formed inwardly to extend upward from inner surfaces 157 of the radial wall portions 156, and spaced radially around an inner area of the outer sleeve 110. In this manner, the radial wall portions 156 are sized large enough to surround and partially enclose the second collar section 126*b* of the inner sleeve 106, while the protrusions 118 are sized and shaped to slide through the slots 120. Thus, the inner surfaces 157 can be slidably or frictionally interfaced to outer surfaces 159 of respective spring support portions 136 of the second collar section 126*b* of the inner sleeve 106. This "friction" interface helps to prevent the outer sleeve 110 from falling off or sliding off from the inner sleeve 106.

Figure 7:
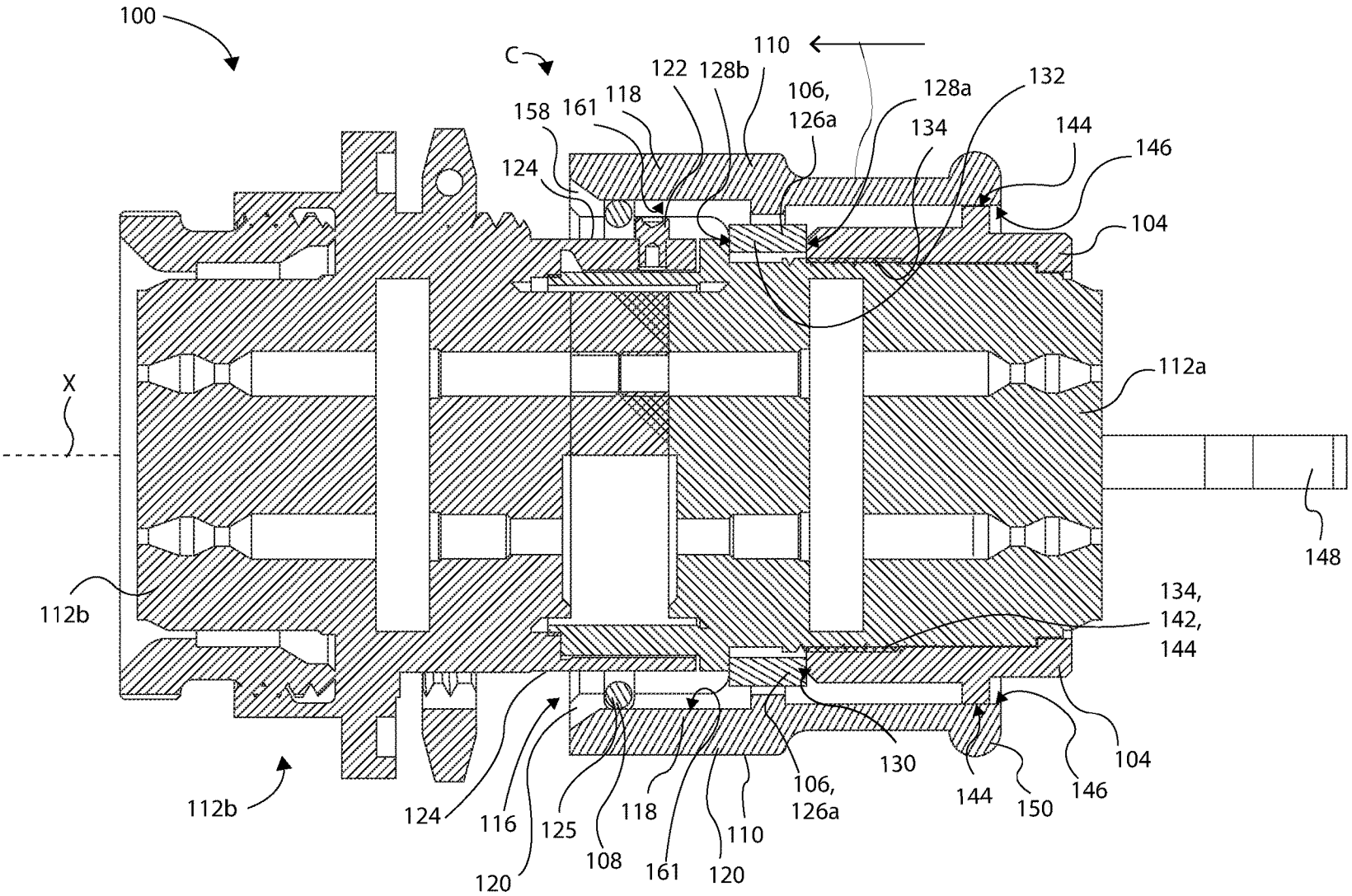
FIG. 7 is a front view of the quick connect system of FIG. 5, showing the quick connect adapter in a compressed state to lock a pair of mated cable connector bodies together.

Notably, each of the protrusions 118 of the outer sleeve 110 can comprise a spring sliding interface surface 158 (see FIGS. 3, 6, and 7) formed proximate an opening 160 of the outer sleeve 110. The spring sliding interface surfaces 158 can each comprise a ramp that interfaces with the radial compression spring 108 when axially moved between engaged/compressed and disengaged/uncompressed states or positions. Each protrusion 118 can further comprise a spring compression surface 161 that transitions from the spring sliding interface surface 158, and the applies the compression force to the radial compression spring 108 to maintain it in the compressed state C (FIG. 7). Thus, the radial compression spring 108 can concurrently slide about the spring sliding interface surfaces 158, and then concurrently slide along the spring compression surfaces 161 to compress the radial compression spring 108 into its compressed state C. Note that a diameter defined by the spring compression surfaces 161 is less than a diameter of the radial compression spring 108, so that the protrusions 118 can collectively apply an inward compression force against the radial compression spring 108 to deflect it inwardly to the compressed state or position.

As mentioned above, the first and second connector bodies 112*a* and 112*b* could be parts of a pre-existing connector system, such as a military spec bayonet twist type connector system, or other type of connector system. Such connector systems typically include a connector support collar (having arms, similarly as connector support collar 104), and a twistable outer sleeve operable to twist or rotate to engage stop protrusion (like 122) to lock the first and second connector bodies 112*a* and 112*b* together. However, the present quick connect adapter 102 (i.e., connector support collar 104, inner sleeve 106, radial compression spring 108, and outer sleeve 110) could replace such pre-existing outer sleeve of such pre-existing connector system. Moreover, the quick connect adapter 102 can further include the connector support collar 104, which could replace such pre-existing connector support collar that is operable with the pre-existing twistable outer sleeve. Therefore, in a method provided by the present disclosure, an operator can remove a rotary locking mechanism (e.g., the twistable outer sleeve and the pre-existing twistable outer sleeve) from the first connector body 112*a*, and then replace such components with the quick connect adapter as taught herein, such as the quick connect adapter 102 (i.e., an axial locking mechanism). As such, the operator can couple the components of the quick connect adapter 102 to the first connector body 112*a*, as described above in detail, so that the operator can axially move or slide the outer sleeve 110 along the inner sleeve 106 to lock the connection of the first cable connector body 112*a* to the second cable connector body 112*b*. Such method of replacing pre-existing a twistable outer sleeve with an axially moveable outer sleeve can be advantageous in many applications where it is not possible or readily feasible to modify or change the configuration of the first and second connector bodies 112*a* and 112*b*, which is the case with many high performance parts that require strict specifications that do not often change, such as military spec cable connectors.

Figure 8:
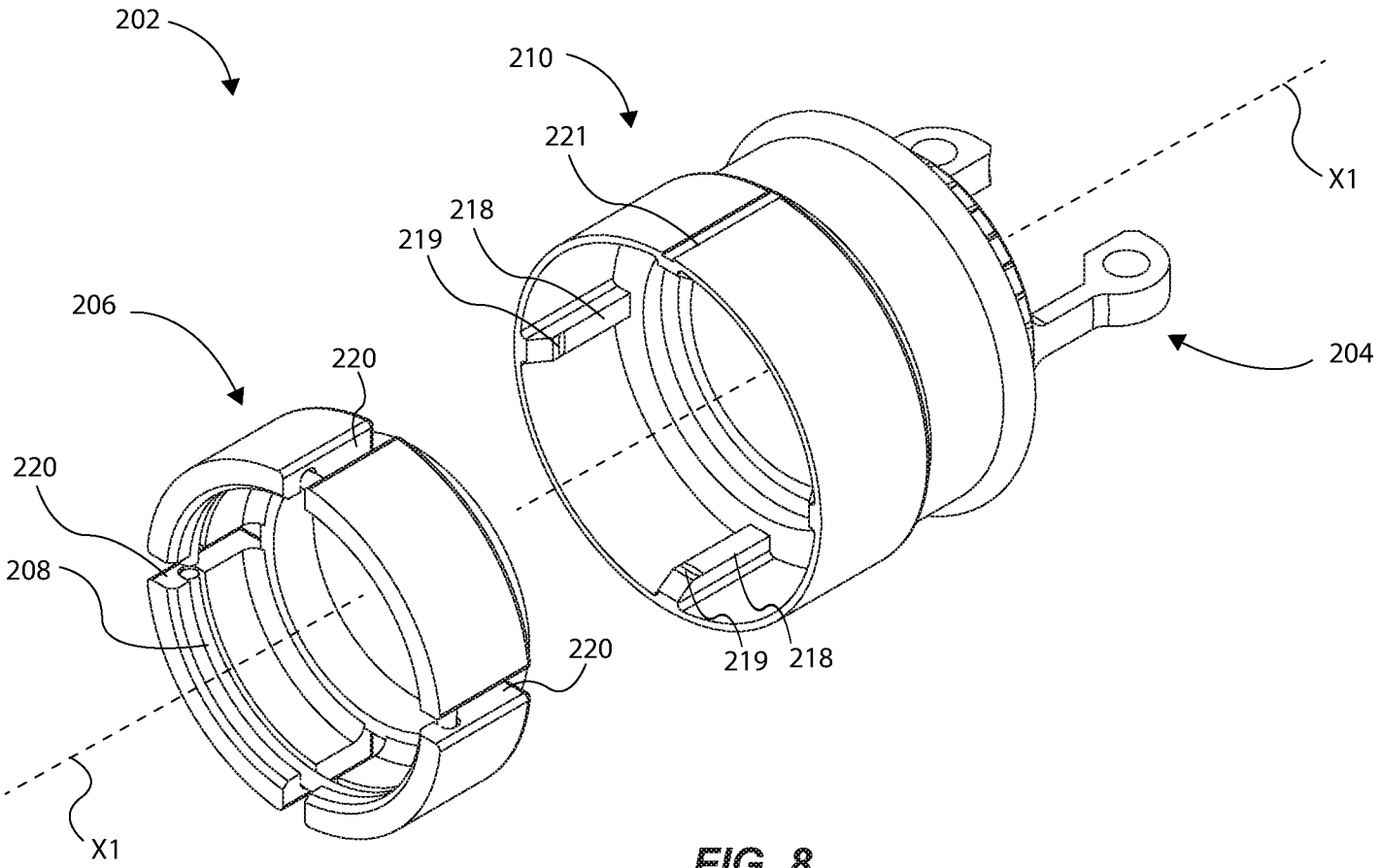
FIG. 8 is a partially exploded isometric view of a some components of a quick connect system, in accordance with an example of the present disclosure.
Figure 9:
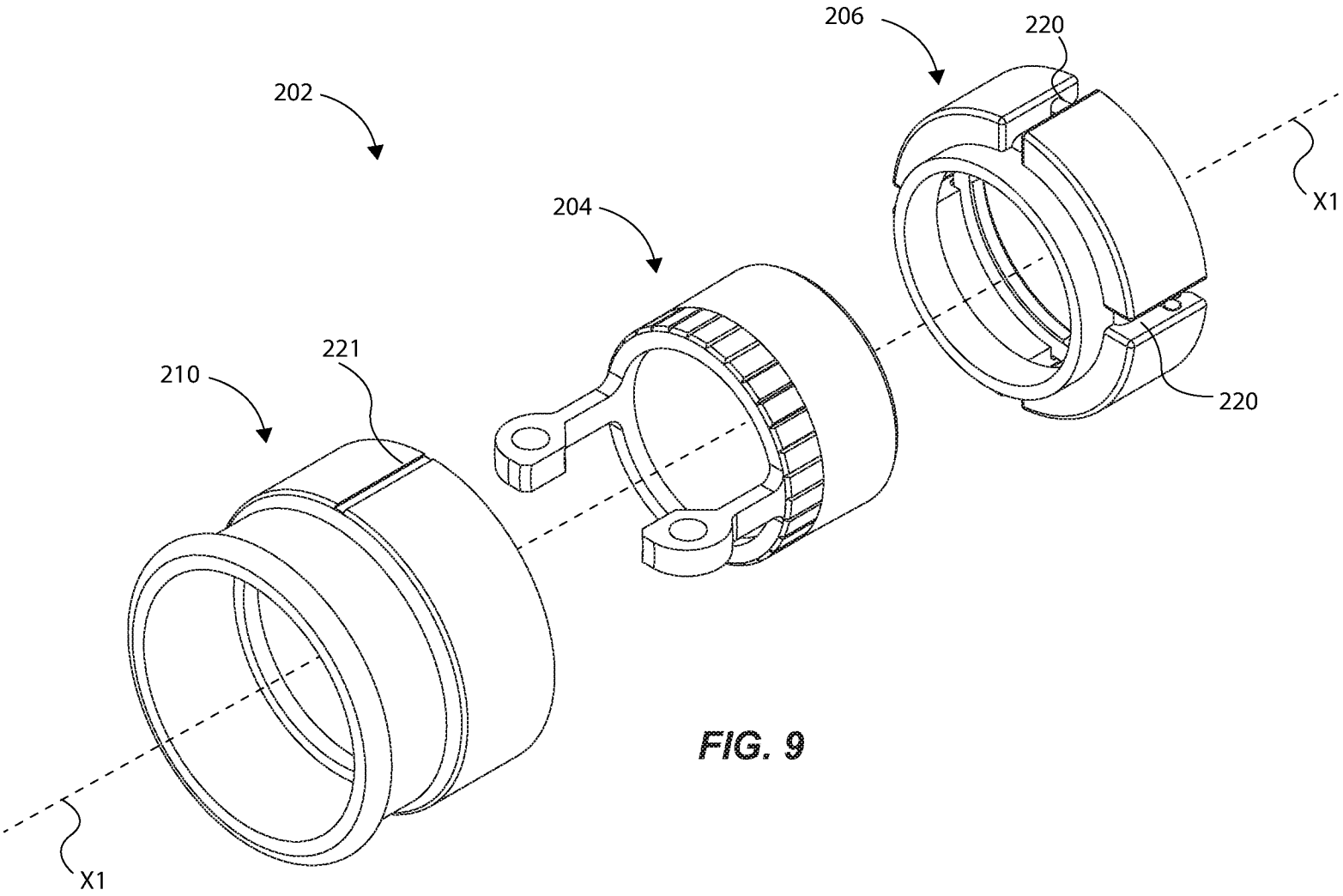
FIG. 9 is an exploded isometric view of the quick connect system of FIG. 8.

FIGS. 8 and 9 show an alternative quick connect adapter 202 that includes a connector support collar 204, an inner sleeve 206, a radial compression spring 208, and an outer sleeve 210. The quick connect adapter 202 can be operable with components of the quick connect system 100 described above, such as being operable with the first and second connector bodies 112*a* and 112*b*. Thus, the quick connect adapter 202 can replace the aforementioned connector support collar 104, the inner sleeve 106, the radial compression spring 108, and the outer sleeve 110. Therefore, it should be appreciated from the views of FIGS. 8 and 9 that the quick connect adapter 202 can have similar structure and functionality as the quick connect adapter 102, with the exception of the following differences discussed in detail.

Thus, one notable difference is that a plurality of protrusions 218 of the outer sleeve 210 each include a recessed seat 219 formed laterally through the protrusion 218 for receiving and seating the radial compression spring 208. Therefore, as the protrusions 218 slide through respective slots 220 of the inner sleeve 206 (when the outer sleeve 210 is axially slid over the inner sleeve 206 about and along axis X1), the radial compression spring 208 can "pop" into or seat into the recessed seats 219. This improves or maximizes a locking force of the radial compression spring 208 to the outer sleeve 210.

Another notable difference is that the outer sleeve 210 can further comprise a clock indicator recess 221 formed along an outer surface of the outer sleeve 210 and along an axis X1. The clock indicator recess 221 can be colored or painted, and can be used to assist the user to radially line-up or clock the outer sleeve 210 relative to a cable attached to a second connector body (e.g., 112*b*). This can help ensure that connector bodies (e.g., 112*a* and 112*b*) are properly radially aligned when being mated, and when being locked together by the quick connect adapter 202.

Finally, another notable difference is that the connector support collar 204 (known as "a back shell") can be an existing or known component that can be used with the inner sleeve 206, the radial compression spring 208, and the outer sleeve 210. Therefore, when replacing the pre-existing twistable lock components, as discussed above, the connector support collar 204 may not need replaced (as would be the case with connector support collar 104 that does replace a pre-existing back shell or the connector support collar 204). This system can reduce part count to replace existing twist lock components, because the connector support collar 204 does not need replaced. In this manner, the quick connect adapter 202 may not necessary comprise the connector support collar 204, and may instead only comprise the three components of the inner sleeve 206, the radial compression spring 208, and the outer sleeve 210.

Reference was made to the examples illustrated in the drawings and specific language was used herein to describe the same. It will nevertheless be understood that no limitation of the scope of the technology is thereby intended. Alterations and further modifications of the features illustrated herein and additional applications of the examples as illustrated herein are to be considered within the scope of the description.

Although the disclosure may not expressly disclose that some embodiments or features described herein may be combined with other embodiments or features described herein, this disclosure should be read to describe any such combinations that would be practicable by one of ordinary skill in the art. The user of "or" in this disclosure should be understood to mean non-exclusive or, i.e., "and/or," unless otherwise indicated herein.

Furthermore, the described features, structures, or characteristics may be combined in any suitable manner in one or more examples. In the preceding description, numerous specific details were provided, such as examples of various configurations to provide a thorough understanding of examples of the described technology. It will be recognized, however, that the technology may be practiced without one or more of the specific details, or with other methods, components, devices, etc. In other instances, well-known structures or operations are not shown or described in detail to avoid obscuring aspects of the technology.

Although the subject matter has been described in language specific to structural features and/or operations, it is to be understood that the subject matter defined in the appended claims is not necessarily limited to the specific features and operations described above. Rather, the specific features and acts described above are disclosed as example forms of implementing the claims. Numerous modifications and alternative arrangements may be devised without departing from the spirit and scope of the described technology.

What is claimed is:

1. A quick connect adapter for locking a pair of coupled electronic cable connectors, comprising:

an inner sleeve comprising first and second collar sections, the first collar section configured to be secured to a first cable connector body, the second collar section comprising a plurality of slots and a spring seat channel in open communication with the plurality of slots, wherein the first collar section of the inner sleeve comprises first and second outer planar surfaces configured to be axially biased between the first connector body and a connector support collar attached to the first connector body, thereby securing the inner sleeve to the first connector body;

an outer sleeve comprising a plurality of protrusions formed inwardly about an inner surface of the outer sleeve, each protrusion operable to axially slide through a respective slot of the inner sleeve; and a radial compression spring configured to be supported by the spring seat channel of the inner sleeve, the radial compression spring operable between an uncompressed state and a compressed state, wherein, upon connecting the first cable connector body to a second cable connector body, and in response to axial movement of the outer sleeve in a direction towards the radial compression spring, the plurality of protrusions of the outer sleeve slide through the plurality of slots of the inner sleeve, respectively, to engage and compress the radial compression spring, thus locking the connection of the first cable connector body to the second cable connector body.

2. The quick connect adapter of claim 1, wherein the plurality of slots of the inner sleeve define a plurality of spring support portions, wherein the spring seat channel is formed annularly about inner surfaces of the plurality of spring support portions.

3. The quick connect adapter of claim 1, wherein the first collar section of the inner sleeve comprises an inner diameter less than an inner diameter of the second collar section.

4. The quick connect adapter of claim 1, wherein the radial compression spring is compliant, and comprises a first end and a second end movable relative to each other when operating between the uncompressed and compressed states, the radial compression spring configured to be retained at least partially by the spring seat channel when in both the uncompressed and compressed states.

5. The quick connect adapter of claim 1, wherein the outer sleeve comprises a collar interface surface operable to axially slidably interface with a connector support collar attached to the first cable connector body.

6. The quick connect adapter of claim 1, wherein the plurality of protrusions are spaced radially around an inner area of the outer sleeve, such that the plurality of protrusions are operable to apply an inward compression force to the radial compression spring in response to axially slidably interfacing the outer sleeve with the inner sleeve.

7. The quick connect adapter of claim 6, wherein each protrusion comprises a recessed seat for seating the radial compression spring when the first cable connector body is locked to the second cable connector body.

8. The quick connect adapter of claim 1, further comprising a connector support collar operable to be attached to the first cable connector body to secure the inner sleeve to the first cable connector body, wherein the outer sleeve comprises a collar interface surface operable to axially slidably interface with an outer surface of the connector support collar.

9. The quick connect adapter of claim 1, wherein the outer sleeve comprises a clock indicator recess formed along an outer surface of the outer sleeve to align the outer sleeve with the second cable connector body.

10. A quick connect system for locking a pair of coupled cable connectors, comprising:

a first cable connector body comprising a mating end;

a second cable connector body comprising a mating end for coupling to the mating end of the first cable connector body, the second cable connector body having an outer surface and at least one stop protrusion extending from the outer surface;

a connector support collar coupled to the first cable connector body;

an inner sleeve comprising first and second collar sections, the first collar section axially biased between the connector support collar and the first cable connector body, the second collar section comprising a plurality of slots and a spring seat channel in open communication with the plurality of slots;

an outer sleeve slidably interfaced to the connector support collar, and comprising a plurality of protrusions formed inwardly about an inner surface of the outer sleeve; and a radial compression spring supported by the spring seat channel of the inner sleeve, and operable between an uncompressed state and a compressed state, wherein, when the first and second cable connector bodies are connected to each other, the outer sleeve is operable to axially slide about the inner sleeve towards the radial compression spring, such that the plurality of protrusions slide through respective slots of the inner sleeve to engage and compress the radial compression spring around the outer surface of the second cable connector body adjacent the at least one stop protrusion to lock the connection of the first cable connector body to the second cable connector body.

11. The quick connect system of claim 10, wherein the at least one stop protrusion comprises a plurality of stop protrusions extending outwardly from the outer surface of the second cable connector body, wherein the plurality of stop protrusions are configured to restrict axial movement of the radial compression spring in a direction toward the first connector body when in the compressed state.

12. The quick connect system of claim 10, wherein the first and second cable connector bodies are locked together via axial movement of the outer sleeve relative to the inner sleeve to compress the radial compression spring, such that rotational movement of the outer sleeve is not required to lock the first and second cable connector bodies together.

13. The quick connect system of claim 10, wherein the first collar body section of the inner sleeve comprises opposing annular surfaces axially biased between the first cable connector body and the connector support collar, thereby securing the inner sleeve to the first cable connector body.

14. The quick connect system of claim 10, wherein the outer sleeve comprises a collar interface surface slidably interfaced with an outer surface of the connector support collar.

15. The quick connect system of claim 10, wherein the first and second cable connector bodies form at least part of a military spec connector.

16. A method for locking a pair of coupled cable connectors together, comprising:

connecting a first cable connector body to a second cable connector body, the second cable connector body comprising a mating end, an outer surface, and at least one stop protrusion extending from the outer surface, the first cable connector body comprising a mating end for coupling to the mating end of the second cable connector body;

sliding an inner sleeve over the first cable connector body and around a connection interface of the first and second cable connector bodies, the inner sleeve comprising first and second collar sections, the second collar section comprising a plurality of slots and a spring seat channel in communication with the plurality of slots, and supporting a radial compression spring;

coupling a connector support collar to the first cable connector body to secure the inner sleeve to the first cable connector body, wherein the first collar section is axially biased between the connector support collar and the first cable connector body;

sliding an outer sleeve over the connector support collar and the inner sleeve; and axially slidably engaging the outer sleeve about the inner sleeve towards the radial compression spring to cause a plurality of protrusions formed inwardly about an inner surface of the outer sleeve to slidably engage respective slots of the inner sleeve, and to engage and compress the radial compression spring around the second cable connector body, thereby locking the connection of the first cable connector body to the second cable connector body.

17. The method of claim 16, further comprising sliding the outer sleeve away from the radial compression spring, such that the plurality of protrusions are disengaged and uncompressed from the radial compression spring to unlock the first connector body from the second connector body.

18. The method of claim 16, wherein the at least one stop protrusion of the second connector body comprises a plurality of stop protrusions, and wherein the radial compression spring is positioned adjacent the plurality of stop protrusions when compressed around the second connector body, such that the plurality of stop protrusions restrict axial movement of the inner sleeve and the radial compression spring.

19. The method of claim 16, wherein each protrusion of the outer sleeve comprises a recessed seat for seating the radial compression spring when the first cable connector body is locked to the second cable connector body.

20. The method of claim 16, further comprising, prior to sliding the outer sleeve over the connector support collar and the inner sleeve, aligning a clock indicator recess of the outer sleeve with the second connector body.

21. A method for replacing a rotary locking mechanism of a pair of cable connectors with an axial locking mechanism, comprising:

removing a rotary locking mechanism from a first cable connector body, the rotary locking mechanism comprising a pre-existing connector support body and a pre-existing twistable connector body, the pre-existing twistable connector body operable to be rotated to lock the first cable connector body to a second cable connector body;

providing an axial locking mechanism that replaces, at least in part, the rotary locking mechanism, the axial locking mechanism comprising a connector support body, an inner sleeve, and outer sleeve, and a radial compression spring;

connecting the first cable connector body to the second cable connector body;

sliding the inner sleeve over the first cable connector body and around a connection interface of the first and second cable connector bodies, the inner sleeve comprising first and second collar sections, the second collar section comprising a plurality of slots and a spring seat channel in communication with the plurality of slots, and supporting the radial compression spring;

coupling the connector support collar to the first cable connector body to secure the inner sleeve to the first cable connector body, wherein the first collar section is axially biased between the connector support collar and the first cable connector body;

sliding the outer sleeve over the connector support collar and the inner sleeve; and axially sliding the outer sleeve about the inner sleeve towards the radial compression spring to cause a plurality of protrusions formed inwardly about an inner surface of the outer sleeve to slidably engage respective slots of the inner sleeve and to engage and compress the radial compression spring around the second cable connector body, thereby locking the connection of the first cable connector body to the second cable connector body.

22. The method of claim 21, further comprising axially sliding the outer sleeve away from the radial compression spring, such that the plurality of protrusions are disengaged and uncompressed from the radial compression spring to unlock the first connector body from the second connector body.

23. The method of claim 21, wherein the second connector body comprises a plurality of stop protrusions extending from an outer surface of the second connector body, wherein locking the connection of the first cable connector body to the second cable connector body comprises compressing the radial compression spring adjacent the plurality of stop protrusions, which restricts axial movement of the inner sleeve and the radial compression spring.

24. A quick connect adapter for locking a pair of coupled electronic cable connectors, comprising:

an inner sleeve comprising first and second collar sections, the first collar section configured to be secured to a first connector body, the second collar section comprising a plurality of slots and a spring seat channel in open communication with the plurality of slots;

an outer sleeve comprising a plurality of protrusions formed inwardly about an inner surface of the outer sleeve, each protrusion operable to axially slide through a respective slot of the inner sleeve, wherein the plurality of protrusions are spaced radially around an inner area of the outer sleeve; and a radial compression spring configured to be supported by the spring seat channel of the inner sleeve, the radial compression spring operable between an uncompressed state and a compressed state, wherein, upon connecting the first cable connector body to a second cable connector body, and in response to axial movement of the outer sleeve in a direction towards the radial compression spring, the plurality of protrusions of the outer sleeve slide through the plurality of slots of the inner sleeve, respectively, to engage and apply an inward compression force to the radial compression spring to compress the radial compression spring in response to axially slidably interfacing the outer sleeve with the inner sleeve, thus locking the connection of the first cable connector body to the second cable connector body.

25. A quick connect adapter for locking a pair of coupled electronic cable connectors, comprising:

an inner sleeve comprising first and second collar sections, the first collar section configured to be secured to a first connector body, the second collar section comprising a plurality of slots and a spring seat channel in open communication with the plurality of slots;

an outer sleeve comprising a plurality of protrusions formed inwardly about an inner surface of the outer sleeve, each protrusion operable to axially slide through a respective slot of the inner sleeve, the outer sleeve comprising a clock indicator recess formed along an outer surface of the outer sleeve; and a radial compression spring configured to be supported by the spring seat channel of the inner sleeve, the radial compression spring operable between an uncompressed state and a compressed state, wherein, upon connecting the first cable connector body to a second cable connector body, and in response to axial movement of the outer sleeve in a direction towards the radial compression spring, the plurality of protrusions of the outer sleeve slide through the plurality of slots of the inner sleeve, respectively, to engage and compress the radial compression spring, thus locking the connection of the first cable connector body to the second cable connector body, and wherein the clock indicator recess facilitates alignment of the outer sleeve with the second connector body.

* * * * *